United States Patent [19]

Schmitt et al.

[11] Patent Number: 4,899,533

[45] Date of Patent: Feb. 13, 1990

[54] MOTOR MOUNT FOR FALSE TWIST TEXTURING UNIT

[75] Inventors: Gunther Schmitt, Hammelburg; Christian Schmitt, Völkersleier, both of Fed. Rep. of Germany

[73] Assignee: FAG Kugelfischer Georg Schafer (KGaA), Fed. Rep. of Germany

[21] Appl. No.: 275,404

[22] Filed: Nov. 23, 1988

[30] Foreign Application Priority Data

Dec. 23, 1987 [DE] Fed. Rep. of Germany ..... 3743708

[51] Int. Cl.[4] ..... D01H 1/244; D01H 7/92

[52] U.S. Cl. ..... 57/339; 57/100; 57/343; 57/349

[58] Field of Search ..... 57/406, 332, 334–343, 57/347, 348, 349, 100, 264

[56] References Cited

U.S. PATENT DOCUMENTS

| | | | |
|---|---|---|---|
| 4,051,655 | 10/1977 | Lorenz et al. | 57/339 |
| 4,055,940 | 11/1977 | Muschelknautz et al. | 57/100 X |
| 4,135,356 | 1/1979 | Wolstencroft | 57/100 X |
| 4,144,700 | 3/1979 | Takai et al. | 57/264 |
| 4,148,178 | 4/1979 | Roschle | 57/264 |
| 4,226,080 | 10/1980 | Bieber et al. | 57/339 |
| 4,445,322 | 5/1984 | Satterfield | 57/264 |
| 4,543,780 | 10/1985 | Müller et al. | 57/100 X |
| 4,566,262 | 1/1986 | Schmucker | 57/264 |

FOREIGN PATENT DOCUMENTS

| | | |
|---|---|---|
| 7524158 | 5/1976 | Fed. Rep. of Germany . |
| 7525192 | 5/1976 | Fed. Rep. of Germany . |
| 2607290 | 7/1977 | Fed. Rep. of Germany . |
| 2820816 | 2/1981 | Fed. Rep. of Germany . |

*Primary Examiner*—Joseph J. Hail, III

*Attorney, Agent, or Firm*—Ostrolenk, Faber, Gerb & Soffen

[57] ABSTRACT

A false twist texturing unit for filaments comprising a motor block arranged in a stationary manner on the machine, stator defined in the motor block, a shaft of the texturing unit including a rotor thereon with the rotor located in the stator and supported and rotatable therin. Various filament monitoring devices, data transmission elements and a filament cutting device, or the like elements, are supported in a stationary manner in the motor block and are thereby protected from distrubances, like those experienced during a repair.

14 Claims, 4 Drawing Sheets

MOTOR MOUNT FOR FALSE TWIST TEXTURING UNIT

BACKGROUND OF THE INVENTION

The invention relates to a false-twist texturing unit for endless synthetic filaments, to the drive thereof and particularly to the manner of assembly of the drive elements.

False twist texturing units with electric motor drives are known. But in practice, they only have externally arranged motors. Federal Republic of Germany Patent 28 20 816 describes a spinning or twisting machine in which a row of spindles are operated by individual motors. That patent also shows a texturing machine. In that case, the drive motor is fastened externally of the unit on a base plate which is adapted to the existing conditions. The drive to the unit in that case is delivered by a toothed belt drive.

The external application of the drive motor has a number of disadvantages. In addition to the necessarily cantilevered construction which takes up a great deal of space, the relatively long drive belt is a great disadvantage, particularly with respect to the noise it produces. Since only one toothed belt is used, an additional tensioning roller must be installed. This requires the use of a total of four toothed discs or gears, which are subject to early wear due to the various deflections.

Another technical as well as economic disadvantage results from the above described construction of the unit. For repair of the unit, either upon replacement of a bearing, regeneration of the false twisting discs or replacement thereof, or replacement of the toothed belt, etc., the entire unit, including the motor, must be removed from the machine. In this case, various factors, such as wiring off the motor and adjustment of the unit with all its additional devices are affected not only upon the dismantling but also upon the assembly. This results in standstill times which lead to a drop in production.

In Federal Republic of Germany Published Application OS 26 07 920, a friction false twisting texturing unit is disclosed. The unit shown therein has three motors, with one of the motors being integrated into each set of discs. In addition to the extremely high financial expense of this construction, it is also unfeasible from a technical standpoint. Such a set of discs is used at speeds of rotation of up to 12,000 rpm and must travel free of imbalance. This is not possible with a rotating outer ring, as shown in FIG. 3 of that publication, and can be made possible in the case of FIG. 4 thereof only under very cumbersome and difficult conditions, as is clear to one skilled in the art. Furthermore, concentricity of the discs, which is indispensable for good quality of the yarn, cannot be obtained in the required quality. In the event of wear of only one disc, for instance, the entire set of discs, including the rotor, can no longer be used. The self contained structure furthermore has great difficulties inherent in it, both upon mounting and upon dismounting, even for a person skilled in the art.

Another disadvantage resides in synchronizing the three motors with respect to each other since the three sets of discs must not experience any differences in their speeds of rotation, as this would lead to start-up difficulties of the thread or poor quality yarn.

SUMMARY OF THE INVENTION

The object of the present invention is to avoid the above disadvantages and to provide a motor-driven texturing unit, which is technically and economically suitable and can be easily mounted and serviced.

The invention concerns a false twist texturing unit for a filament, particularly an endless filament, and more particularly a synthetic material filament. The texturing unit is conventionally electric motor driven. The texturing unit includes a motor block which is arranged in a stationary manner to be supported on the machine and may even be integrated into a machine rail. The motor block supports and has within it the motor stator, and the stator is thereby supported and held stationary in the motor block.

At least one filament texturing disc is supported on a shaft. The shaft has the motor rotor at one end. The rotor, in turn, is disposed in and supported in the stator in the motor block.

A typical false texturing unit has a plurality of shafts, each supported for rotation. Each of the shafts carries a respective set of texturing discs. The shafts are typically so placed and the texturing discs are typically so sized that the discs on the shafts are at least partially interleaved, whereby a filament drawn along the length of a shaft is contacted by all of the texturing discs.

Various filament monitoring devices are arranged in a fixed manner in the motor block and are protected from disturbances, like those which occur upon repair of the unit, replacement of the shaft and discs, etc. The monitoring devices might include filament tensile force measuring means, twist monitoring means, and the like. Various data acquisition outputs are defined in the motor block and communicate with the monitoring means for providing a manner of connection to the data acquisition means for obtaining the data from the filament monitoring means. Those data acquisition means are integrated in a stationary manner in the motor block. Further, a filament cutting device may be provided. Finally, motor speed regulation means and motor speed monitoring means may be integrated in the motor block, as well.

The invention proceeds from the false-twist texturing unit described above. With the invention, it is unimportant whether a friction disc unit with three-shaft arrangement, a magnetic false-twisting unit or a single-shaft disc unit is used. One of the shafts is designed with a motor rotor arranged on it. For this purpose, for instance, upon the convenience of an existing unit to the invention, the shaft of the mount which had previously been equipped with a drive whorl for tangential drive off a drive belt, merely has the drive whorl removed.

The stator is fixed in position in the motor block or housing. The rotor is fixed in the stator by the double support of the unit, which also carries the friction discs and the suitably developed motor block, so that no further fixing in position is necessary.

The motor block is fastened fixed on the spindle rail of the machine. In the event of possible repairs, the block need not be removed from the rail.

Previously, thread monitoring, which requires a very precise adjustment, or similar means which were heretofore integrated in the unit, were detrimentally affected upon each new mounting, or upon repairs, or the like. Now thread monitoring is integrated in the motor block, which remains in the machine, and it is not exposed to any risk of injury. Furthermore, wiring or cable connections for data acquisition are not longer affected during the removal of the unit.

A long halt in production is substantially prevented by the immediate insertion of a unit which is merely pushed into the motor block. Readjustment is no longer necessary.

There is an additional advantage upon reequipping or retrofitting a machine. The previous tangential belt drive, and thus all belt tensioning and guide elements, as well as the support mounting of the unit are eliminated. The individual adjustments of the units and of other elements for the drive belt are also no longer necessary.

Together with this, there is a considerable saving of energy as well as a definite reduction in the amount of noise given off. This rounds off the economic advantage as compared with systems that have been previously used.

Other objects and features of the invention are further explained with reference to embodiments shown in the accompanying drawings.

DESCRIPTION OF THE PREFERRED EMBODIMENTS

Figure 1:
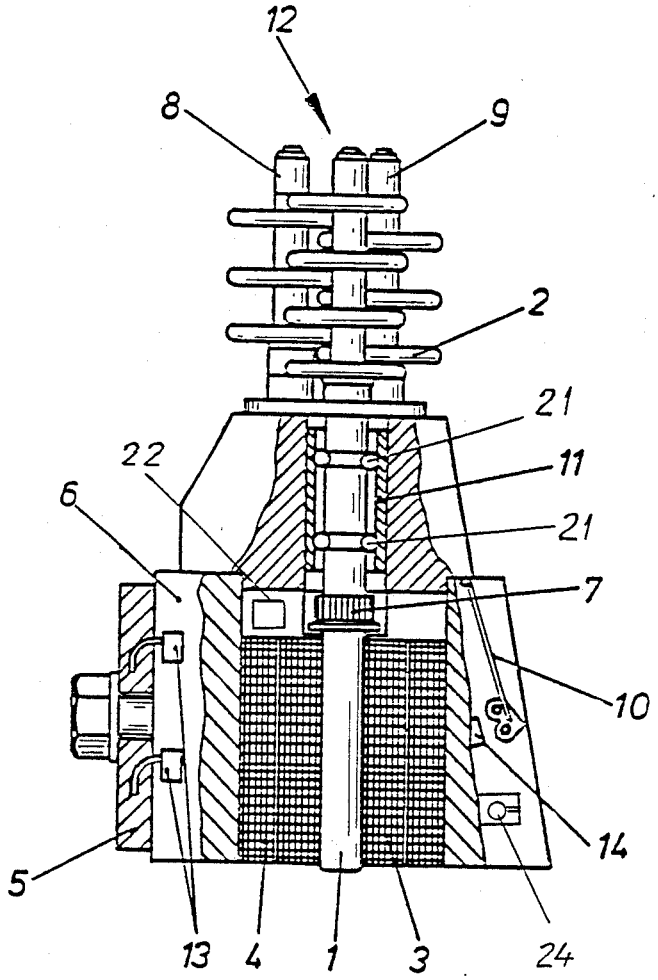
FIG. 1 is a side view of a friction unit driven by an electric motor.
Figure 2:
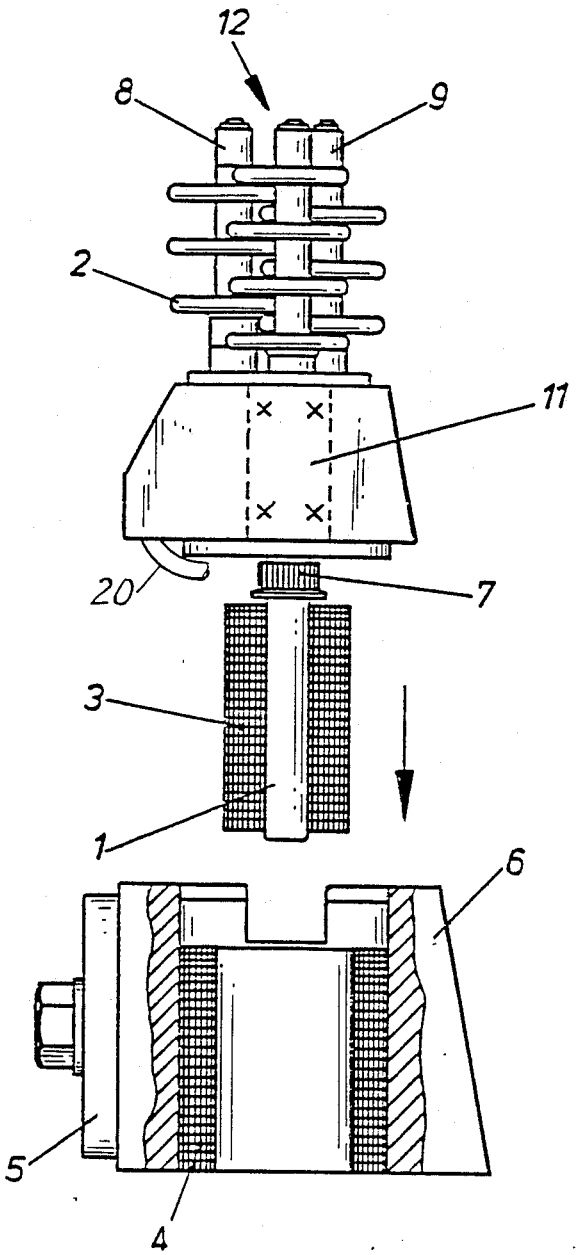
FIG. 2 shows the friction unit before insertion in a motor block.

In FIGS. 1 and 2, the shaft 1 of the unit is firmly attached to the rotor 3. The rotor 3 is fitted into a supporting opening in the stator 4, which opening is shaped to position the rotor while permitting the rotor to rotate as the stator is electrified.

The stator 4 is arranged within the motor block 6, and that block 6, in turn, is fastened in a stationary position to the spindle rail 5 of the machine.

A rotor guide 11 is separate from and is supported on and above the block 6. The rotor guide 11 surrounds rotary bearings 21, which roll in races defined around the shaft 1 and in the interior of the guide 11.

The electric motor, and particularly the stator, is fed and monitored via the electric connections 13.

There is a toothed disc 7 on the shaft 1 above the rotor from which the shafts 8 and 9 are driven by the endless belt 20 that wraps around the disc 7 and around corresponding discs on the shafts 8 and 9. The belt 20 may be a gear belt or a toothed belt and a round or a flat belt.

Filament monitor 10 is connected via connection 14 to a data monitoring system for monitoring various characteristics of the filament. The monitor 10 includes a filament tensile force measuring device and a filament twist measuring device. The connection 14 leads to the output connections 13 through which generated data may be transmitted to remote indicators or control apparatus, not shown.

In addition, the motor rotor speed is monitored and also regulated by the rotor monitor 22, which also may be fastened in the stator block and electrically connected at a connection 13. The monitor 22 both measures the rotor speed and regulates the speed to a desired rate.

A cutting device 24 is also illustrated in FIG. 1.

A filament, not shown, is conventionally supplied, e.g. from a bobbin, not shown, beneath the block 6, and is fed up past all of the partly interleaved discs of the friction disc units 2 and is collected on a collection bobbin, not shown.

FIG. 2 shows the friction disc unit 2, wherein the rotor 3 is arranged on the shaft 1 of the mount 11, at a time prior to its introduction into the motor block 6. The stator 4 is fastened in the motor block 6 in a stationary manner. The motor block 6 is fastened stationary to the spindle rail 5 of the machine.

Figure 3:
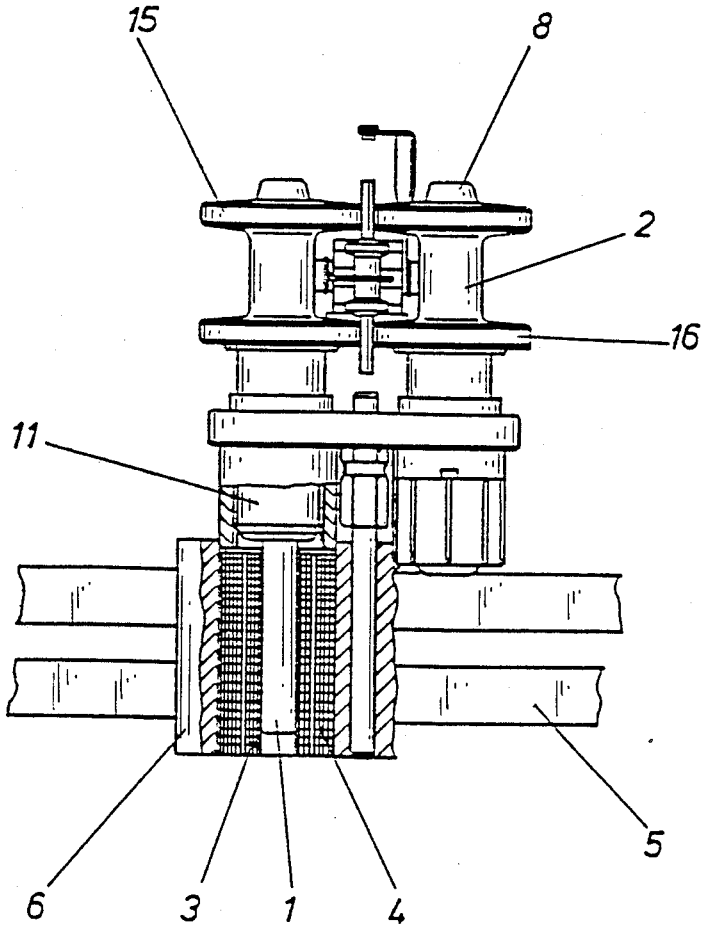
FIG. 3 is a front view of a magnetic false-twist spindle driven by an electric motor.

FIG. 3 is a front view of a magnetic false-twisting spindle 2, which is driven by an electric motor. The rotor 3 is also arranged on the shaft 1 of the mount 11. The stator 4 is seated in the motor block 6, which is fastened in a stationary fashion to the spindle rail 5 of the machine.

The further device of the unit 2 takes place via friction against the two friction discs 15 and 16.

Figure 4:
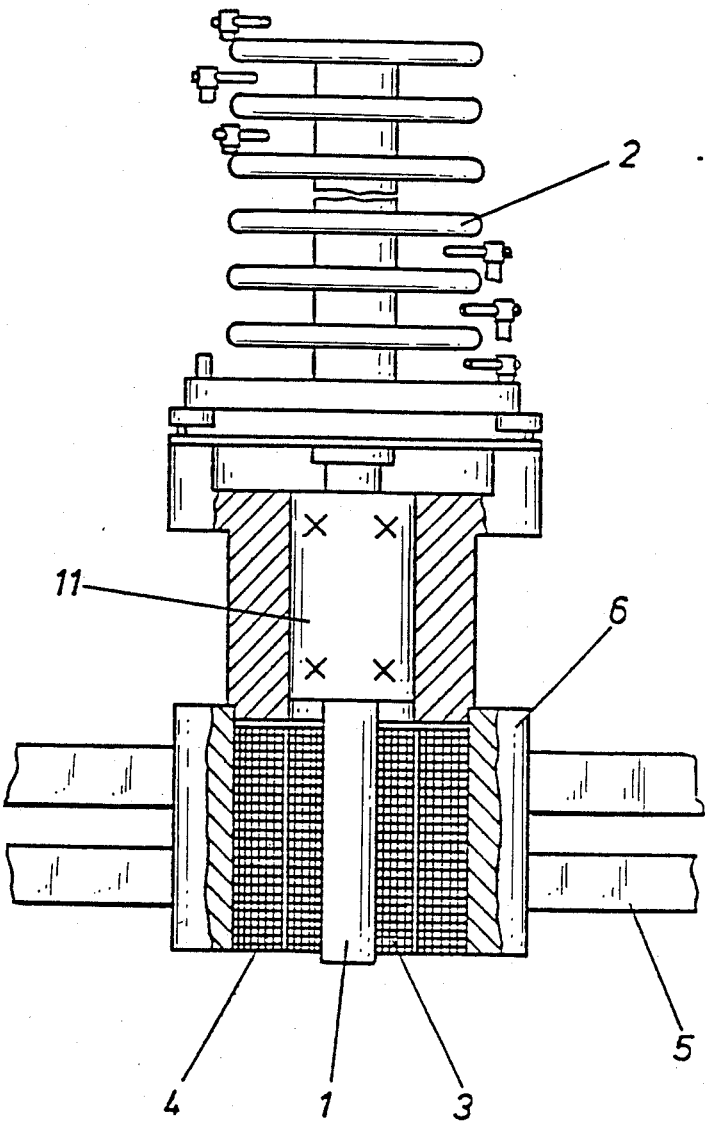
FIG. 4 is a single shaft friction unit driven by a motor.

FIG. 4 shows a single-shaft friction unit 2, in which, once again, the rotor 2 is fastened on the shaft 1 of the mount 11. The rotor, in turn, is seated in the stator 4 of the motor block 6, which is arranged in a stationary manner on the spindle rail 5 of the machine.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. Apparatus for false twist textúring a filament, said apparatus comprising:
   (a) a machine frame;
   (b) a plurality of discs for false twist texturing a filament and a first shaft for rotating at least one of said discs, said discs being removably associated with said frame; and
   (c) a motor, including:
      (1) a motor block stationarily connected to said machine frame;
      (2) a stator fixed within said motor block; and
      (3) a rotor removably held within said stator, said rotor being connected to said shaft so that said rotor, shaft, and at least one disc can be removed as a unit from said motor block and thereby from said machine frame.

2. Apparatus of claim 1, further comprising second and third shafts, texturing discs connected to said second and third shafts and interleaved with said at least one disc, and a drive belt for driving said second and third shafts in synchronism with said first shaft.

3. Apparatus for false-twist texturing a filament, said apparatus comprising:
   (a) a machine frame;
   (b) a motor block fastened in a stationary position to said machine frame, and a stator fixed within said motor block; and
   (c) a rotor located within said stator, a first shaft connected to said rotor, a rotor guide for guiding said rotor, and a texturing disc connected to said shaft, said rotor guide being supported on and separable from said motor block, said texturing disc, shaft, rotor guide, and rotor being removable from said motor block as a unit without removing said motor block from said machine frame.

4. Apparatus of claim 3, further comprising motor rotor speed regulating means and motor monitoring means integrated in the motor block.

5. Apparatus of claim 3, further comprising at least one other shaft supported on the motor block and rotatable with respect to the motor block; at least one other texturing disc supported on the other shaft; the first mentioned shaft and other shaft being so placed and the texturing discs being so shaped and placed that the texturing discs in part interleave, whereby a filament moved along the direction of the shafts is textured by contact with the one and the other of the texturing discs;

a belt drive element associated with the first mentioned shaft, a belt driven by the belt drive element, the belt extending from the first mentioned shaft, and a driven element on the other shaft for receiving the belt for enabling synchronous drive of the other shaft from the belt drive element.

6. Apparatus of claim 3, wherein a plurality of texturing discs are connected to said shaft.

7. Apparatus of claim 3, wherein said rotor guide is centered above said motor block.

8. Apparatus of claim 7, wherein said rotor guide includes bearings for rotatably supporting said shaft.

9. Apparatus of claim 3, further comprising filament monitoring means for monitoring a characteristic of a filament moving through said machine, said monitoring means being stationarily connected to said motor block so that said texturing disc, shaft, rotor guide, and rotor can be removed as a unit from said motor block without disconnecting said monitoring means from said motor block.

10. Apparatus of claim 9, wherein the filament monitoring means comprises a filament tensile force measuring means.

11. Apparatus of claim 9, wherein the filament monitoring means comprises a filament twist monitoring means.

12. Apparatus of claim 9, wherein the filament monitoring means further comprises a data acquisition output in the motor block and connected with the means monitoring a characteristic, the data acquisition output being for transmitting elsewhere data which is generated by the filament monitoring means.

13. Apparatus of claim 3, further comprising a filament cutting device, said cutting device being stationarily connected to said motor block so that said texturing disc, shaft, rotor guide, and rotor can be removed as a unit from said motor block without disconnecting said cutting device from said motor block.

14. Apparatus of claim 3, wherein said unit can be reconnected to said motor block without readjustment.

* * * * *